US007090004B2

(12) United States Patent
Warren et al.

(10) Patent No.: US 7,090,004 B2
(45) Date of Patent: Aug. 15, 2006

(54) CEMENT FLOAT

(75) Inventors: Tommy M. Warren, Coweta, OK (US); Per G. Angman, Calgary (CA)

(73) Assignee: Tesco Corporation, Calgary (CA)

( * ) Notice: Subject to any disclaimer, the term of this patent is extended or adjusted under 35 U.S.C. 154(b) by 206 days.

(21) Appl. No.: 10/710,038

(22) Filed: Jun. 14, 2004

(65) Prior Publication Data

US 2005/0023000 A1 Feb. 3, 2005

Related U.S. Application Data

(60) Provisional application No. 60/477,787, filed on Jun. 12, 2003.

(51) Int. Cl.
*E21B 33/13* (2006.01)

(52) U.S. Cl. ..... 166/135; 122/126

(58) Field of Classification Search ..... 166/135, 166/126, 122

See application file for complete search history.

(56) References Cited

U.S. PATENT DOCUMENTS

| | | | | |
|---|---|---|---|---|
| 1,949,498 A | | 3/1934 | Stone et al. | |
| 2,114,373 A | | 4/1938 | Edwards | |
| 2,313,178 A | | 3/1943 | Spang | |
| 2,382,455 A | | 8/1945 | Turechek | |
| 2,651,371 A | | 9/1953 | Toelke | |
| 3,860,067 A | | 1/1975 | Rodgers | |
| 4,674,569 A | * | 6/1987 | Revils et al. | 166/154 |
| 5,819,846 A | | 10/1998 | Bolt, Jr. | |
| 6,082,451 A | * | 7/2000 | Giroux et al. | 166/72 |
| 6,497,291 B1 | * | 12/2002 | Szarka | 166/386 |
| 2004/0060700 A1 | * | 4/2004 | Vert et al. | 166/291 |

FOREIGN PATENT DOCUMENTS

WO WO 2004/053288 6/2004

* cited by examiner

*Primary Examiner*—Frank Tsay
(74) *Attorney, Agent, or Firm*—Bennett Jones LLP

(57) ABSTRACT

A cement float for use in a wellbore tubing string includes: a mandrel having a bore extending from a first end to a second end including a fluid flow control device therein, and outer surfaces defining a tapering outer diameter from the first end to the second end; an outer lock sleeve having an outer surface and a sleeve bore therethrough, the outer lock sleeve retained at least about the outer surfaces of the mandrel surfaces and defining interfaces therebetween, the sleeve being expandable radially outwardly by driving the mandrel against the sleeve bore to place the cement float in anchoring position within the tubing string.

9 Claims, 3 Drawing Sheets

CEMENT FLOAT

CROSS REFERENCE TO RELATED APPLICATIONS

The present application claims priority from U.S. Provisional Application No. 60/477,787, filed Jun. 12, 2003.

BACKGROUND OF INVENTION

The present invention relates to a cement float for wellbore operations.

In casing drilling the casing string is used both as the drill string and the borehole liner. When drilling is complete, a cement float must be run in through the casing string and is generally landed in a profile nipple, which is a sub in the original casing string that contains an annular groove called a profile. Sometimes however, the profile in the profile nipple is damaged so that it cannot accept a cement float. In such a case and in other instances when the use of a profile nipple is not desirable, a cement float is required that does not rely on the existence of a profile.

SUMMARY OF INVENTION

In accordance with a broad aspect of the present invention, there is provided a cement float for use in a wellbore tubing string includes: a mandrel including a first end, a second end, a bore extending from the first end to the second end including a fluid flow control device therein and outer side surfaces defining a tapering outer diameter from the first end of the mandrel to the second end; an outer lock sleeve including an outer surface and a sleeve bore through the sleeve, the outer lock sleeve retained at least about the outer side surfaces of the mandrel with the mandrel extending through the sleeve bore, the sleeve bore having a taper to complement and be coactable with the tapering outer diameter of the mandrel outer side surfaces and the sleeve bore and the mandrel outer side surfaces defining interfacing surfaces therebetween, the sleeve being expandable radially outwardly by driving the mandrel against the taper of the sleeve bore to place the cement float in an anchored position in the tubing string with the outer lock sleeve wedged between the mandrel and the tubing string, the outer lock sleeve and the mandrel being formed over at least a portion of their interfacing surfaces to be frictionally and/or mechanically interactive to provide self locking against sliding movement therebetween that would dislodge the cement float from its anchored position.

In accordance with another broad aspect of the present invention, there is provided a method for setting a cement float in a wellbore tubular string comprising: providing a cement float including a mandrel including a first end, a second end, a bore extending from the first end to the second end including a fluid flow control device therein and outer side surfaces defining a tapering outer diameter from the first end of the mandrel to the second end; an outer lock sleeve including an outer surface and a sleeve bore through the sleeve, the outer lock sleeve retained at least about the outer side surfaces of the mandrel with the mandrel extending through the sleeve bore, the sleeve bore having a taper to complement and be coactable with the tapering outer diameter of the mandrel outer side surfaces and the sleeve bore and the mandrel outer side surfaces defining interfacing surfaces therebetween, the sleeve being expandable radially outwardly by driving the mandrel against the taper of the sleeve bore; positioning the cement float in the wellbore tubular string; using a setting tool engaged to the mandrel to apply force to the mandrel and applying an opposite force from a setting tool against the outer lock sleeve to drive the tapering outer diameter of the mandrel against the taper of the sleeve to expand the sleeve radially outwardly to both anchor the cement float in the tubular string and seal between the tubular string.

DETAILED DESCRIPTION

Figure 1:
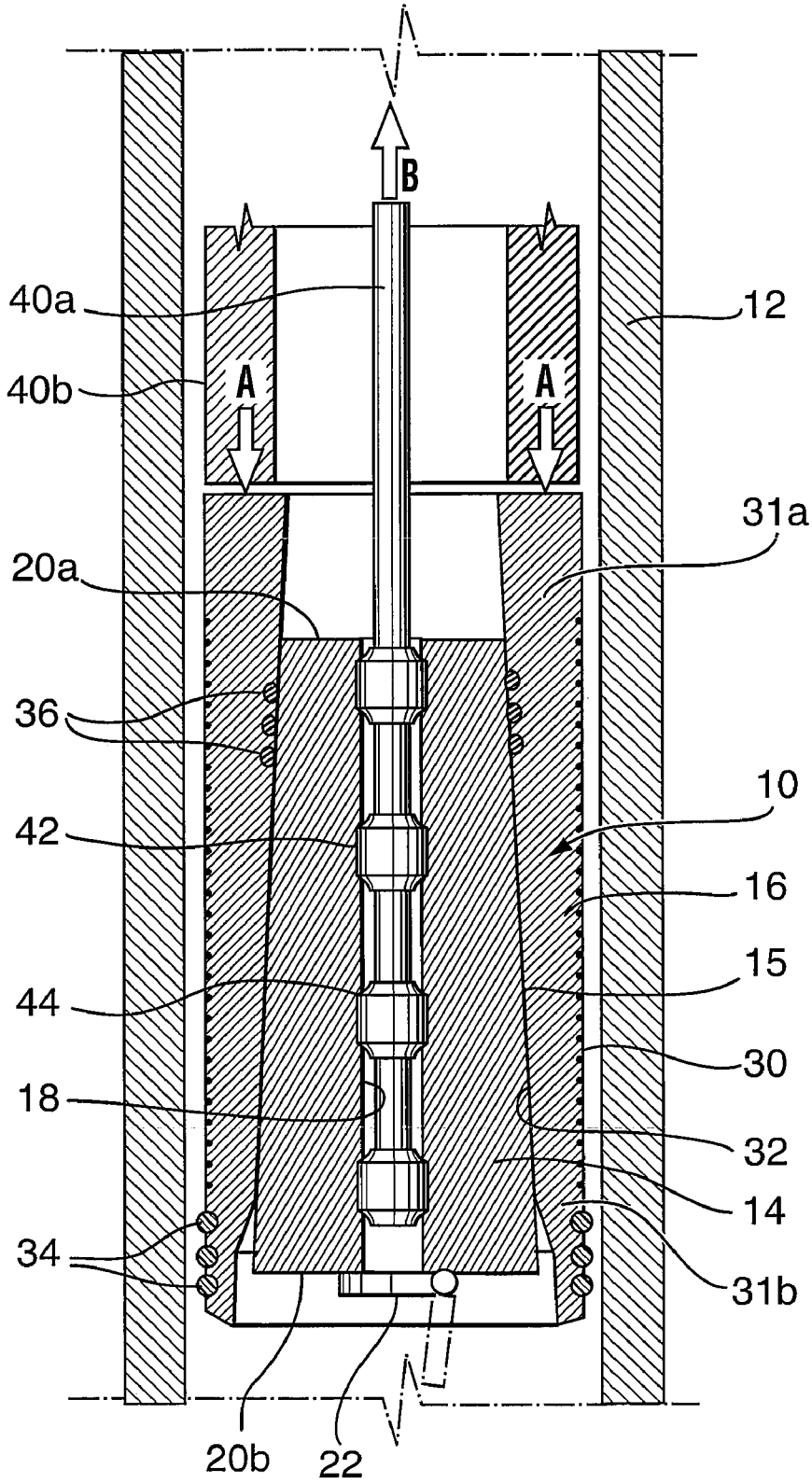
FIG. 1 is a schematic axial sectional view through a cement float in the process of being installed in a wellbore tubing string.

Referring to the drawings, a cement float 10 is shown which can be installed in a wellbore tubing string, such as a casing string, a portion of which is shown at 12. Once installed, the cement float may permit fluid flow downwardly therethrough, but seal against reverse flow upwardly therepast. In a cementing operation, the cement float is installed to permit cement to be pumped down through the wellbore liner and upwardly through the annulus liner/wellbore annulus and will maintain the cement in the annulus, by sealing against reverse flow (called U-tubing) until the cement sets.

The cement float may include a center mandrel 14 including outer side surfaces 15 and an outer lock sleeve 16, which may encircle the mandrel and may be retained by frictional engagement or mechanical engagement on at least the outer side surfaces of mandrel 14.

Mandrel 14 may include a bore 18 extending between its ends 20*a* and 20*b*. A fluid flow control device 22 such as a plug, shearable plug and/or a valve may be disposed in bore 18 to provide for fluid flow control through the bore. For operation of a cement float, generally the fluid flow control device is configured as a check valve to permit flow through the bore from the float's upper end to its lower end, but to seal against reverse flow through the bore.

Outer side surfaces 15 of the mandrel define a tapering outer diameter from one end 20*b* of the mandrel to the other, herein defined as tapered end 20*a*, such that the mandrel may define a frustoconical form on its outer side surfaces.

Outer lock sleeve 16 includes an outer surface 30 and a tapered or frustoconical inner bore 32. The frustoconical inner bore causes the wall thickness of sleeve to taper from a thicker end 31*a* to a thinner end 31*b*. The form of inner bore 32 is selected to complement outer side surfaces 15 of the mandrel over which it is mounted. Inner bore 32 may taper substantially oppositely to the taper of outer side surfaces 15. The sleeve and the mandrel may therefore fit together and the frustoconical surfaces may interact and coact such that when mandrel 14 is moved through bore 32 in a direction to drive the tapered surfaces together, mandrel 14 forces sleeve 16 radially outward ly.

The outer lock sleeve is formed of a deformable material able to radially expand, for example while the sleeve remains continuous about its circumference. The center mandrel is formed of a durable material that is selected to be harder and less deformable than the material of the outer sleeve. The materials of the outer lock sleeve and of the mandrel are selected to withstand wellbore and wellbore cementing conditions. In one embodiment, the materials of the outer lock sleeve and of the mandrel may be selected to be drillable so that the cement float may be drilled out of the tubular string once it has been used. Ability to drill out the cement float may be useful, for example, when it is desired to drill the tubular string out to extend the wellbore. Materials may vary depending on the cutting device to be used for drilling out the wellbore. For example, materials that are drillable by a polycrystalline diamond compact (pdc) type cutters may be useful in some situations. In one embodiment, sleeve materials may include soft metals or polymers, for example polyurethane, rubber, etc. Mandrel materials may include metals, or polymerics such as epoxy grout, phenolics, etc.

Sleeve 16 is retained on mandrel 14 in the unset and set conditions. Sleeve 16 and mandrel 14 can be connected by way of frictional engagement or mechanical engagement, as by use of a return flange or enlargement at the tapered end 20*a* of the mandrel, snug fitting between the parts, surface treatment at the interfacing parts or by forming roughened, toothed, ratcheted or fine threaded surface or surfaces between the parts.

Figure 2:
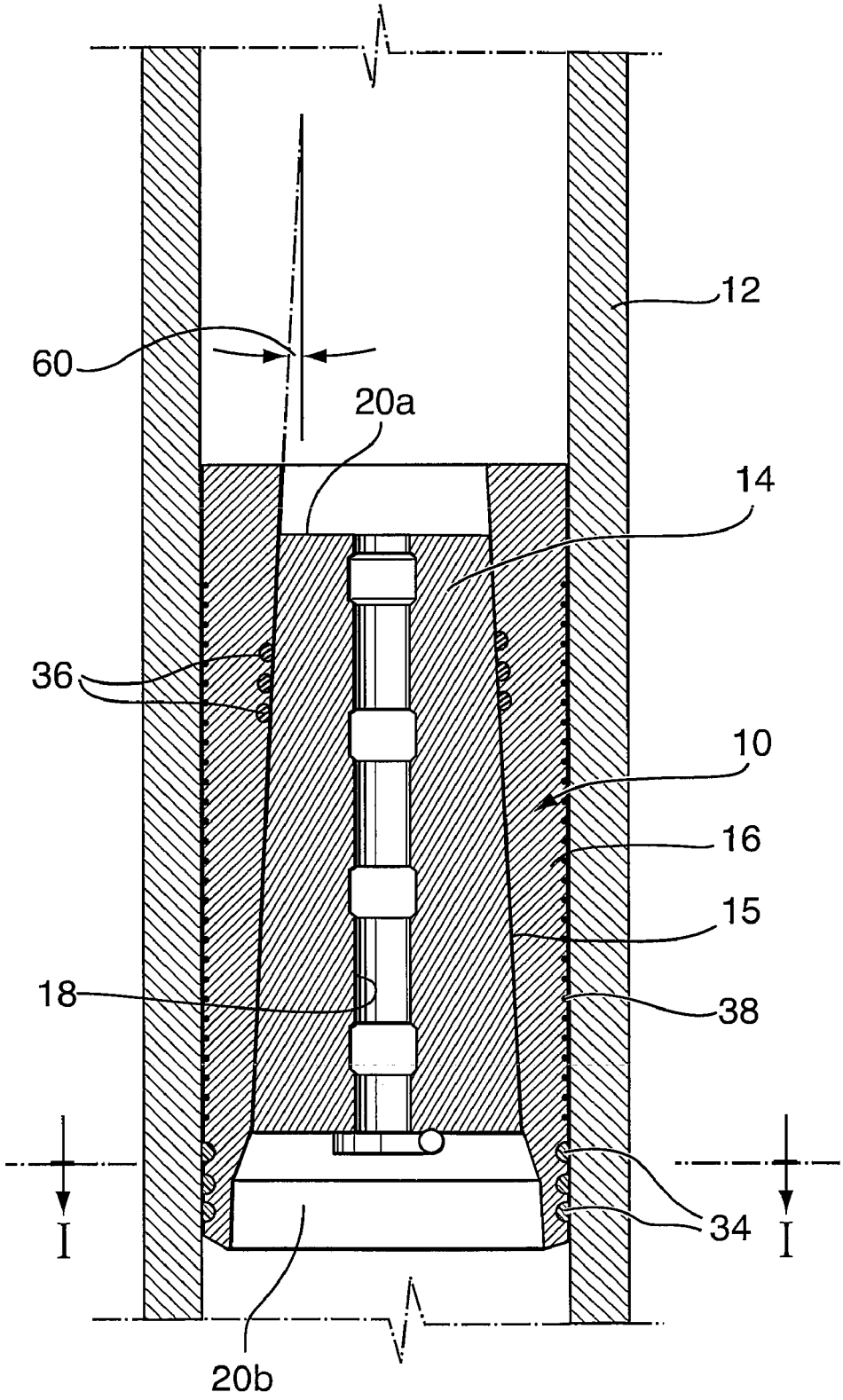
FIG. 2 is a schematic axial sectional view through a cement float installed in a wellbore tubing string.
Figure 3:
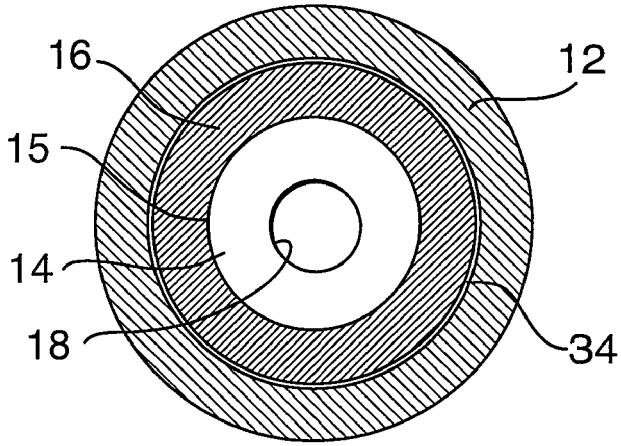
FIG. 3 is a schematic sectional view through a cement float such as along line II of FIG. 2.

In use, cement float 10 is passed through a tubing string, such as casing 12, until it is in a desired position for setting. Sleeve 16 has a normal OD less than the ID of the casing, such that it can pass through the casing to the desired position (FIG. 1), but can be expanded outwardly to wedge between the mandrel and the casing (FIG. 2). In the expanded position, sleeve 16 may act alone to both anchor the cement float in the casing and seal against fluid flow between the mandrel and the casing, thereby forcing any fluid flow past the cement float to be through bore 18. As such, the cement float need not include slips mechanisms or other auxiliary means for setting in the hole and the cement float need not be landed in a profile, although such mechanisms and/or positioning, may be employed if desired.

Radial expansion may be achieved by application of force simultaneously (i) on the sleeve, arrows A, and (ii) on the mandrel in a substantially opposite direction, arrow B. This procedure acts to drive the tapered surfaces of the sleeve and the mandrel against each other to, thereby, force the sleeve, which is deformable, radially outwardly over the frustoconical outer side surfaces of the mandrel, while the mandrel substantially retains its original shape. The forces causing radial expansion are discontinued when the sleeve is sufficiently expanded to anchor the mandrel, by a wedge-lock effect, and fill, and thereby seal, the annulus between mandrel 14 and casing 12. The mandrel remains locked in the expanded sleeve to maintain the expansive forces thereon. In one embodiment, the force applied to the sleeve simply maintains the sleeve in position while the mandrel is pulled upwardly through the sleeve, such that the position of the cement plug can be more accurately selected.

As noted previously, the sleeve and the mandrel can be connected by way of frictional engagement or mechanical engagement, as by use of a return flange or enlargement at the tapered end 20*a* of the mandrel, snug fitting between the parts, surface treatment at the interfacing parts or by forming a ratcheted surface or fine threading between the parts. In one embodiment, the sleeve and the mandrel are formed over at least a portion of their interfacing surfaces to be frictionally and/or mechanically self locking such that the axial position of the sleeve when in contact with the mandrel outer side surfaces is self locking in at least one axial direction, which one axial direction is the direction along which the parts would have to move to move out of their anchored, wedge locked position. In one embodiment, the sleeve and the mandrel are formed over at least a portion of their interfacing surfaces to have a coefficient of friction, as by selection of their angles of taper (relative to the cement float long axis), an angle is indicated at angle 60, to be less than the value defined by the inverse tangent of the coefficient of friction. In the illustrated embodiment employing drillable materials, angle 60 may be less than about 17°. The outer side surfaces of the mandrel and the bore of the sleeve can be prepared to provide a greater frictional coefficient when their tapers are moved together than when the tapers are moved apart. For example, the surfaces can be treated or formed such that axial sliding movement to drive the tapers together is easier than reverse axial sliding, the frictional coefficent being much greater.

Because of the frictional or mechanical engagement between sleeve 16 and mandrel 14 and the coacting frustoconical surfaces, cement float 10, once set by radial expansion of the sleeve can withstand normal operational pressures from both above and below the tool without become dislodged. For example, the mandrel and the sleeve may be locked together by friction or mechanical engagement at their interfacing surfaces such that the sleeve is fixed against movement in a direction opposite the forces represented by arrows A and the mandrel is fixed against movement in a direction opposite the forces represented by arrows B applied. In operation, the tapered surfaces of the mandrel and the sleeve cause the cement float end adjacent the largest diameter mandrel end 20*b* to be capable of withstanding greater pressures than the opposite end. Thus, since a cement float must withstand greatest pressures from below, the cement float may be positioned as shown in the Figures so that the tapered end 20*a* of the mandrel is oriented up hole and end 20*b* of the mandrel is adjacent the high pressure region of the well during cementing. As such, setting of the cement float will occur generally by application of forces A downwardly and forces B upwardly.

Seals may be used to enhance the sealing function of the cement float. For example, one or more seals 34, such as o-rings, etc. of a more deformable material than the sleeve may be provided about the sleeve circumference to enhance sealing between the sleeve and the casing. In addition or alternately, one or more seals 36, such as o-rings, etc. of a more deformable material than the sleeve, may be positioned between the sleeve and the mandrel.

As noted, a cement float generally must withstand greatest pressures from below. Thus, in one embodiment seals 34 may be oriented about sleeve relatively closer to the high-pressure end of the sleeve, which is the thinner end 31*b*, than to end 31*a*. Additionally or alternately, seals 36 may be positioned relatively closer to the low pressure end of the cement float, which is tapered mandrel end 20*a*, than to end 20*b*. In one embodiment, seals 34 may be positioned to act adjacent the high pressure end of the sleeve and seals 36 may be positioned to act between the sleeve and the mandrel adjacent the low pressure end of the cement float. The positioning of the seals in this way tends to allow the sleeve to act as a cup seal when pressure is applied from below, driving the sleeve out into engagement with the casing, rather than compressing the sleeve against the mandrel. To enhance this response, the outer sleeve can be extended and/or tapered to increase its flexibility at its high-pressure end 31*b* such that it tends to further operate as a packer cup.

Outer surface 30 of the outer lock sleeve may be modified, treated or configured to increase its frictional coefficient with the casing. For example, outer surface may be surface treated, coated or imbedded to increase its frictional/gripping properties. In various embodiments, hardening materials 38, such as for example grit, high angularity quartz grains, metal filings, etc. can be impregrated or applied to the outer sleeve surface.

One or more setting tools, generally indicated at 40*a*, 40*b*, may be used to apply the setting forces to the cement float. Many setting tool configurations may be evident to the skilled workman. A setting tool or setting tools that apply opposite axial forces directly to both the sleeve and the mandrel may be useful. In one embodiment, a setting tool may be useful that pulls up on the mandrel while resisting axial movement of, or pushing, the sleeve. In one embodiment, such as that illustrated, a setting tool that applies forces along a plurality of surfaces on the mandrel, as by an interaction between a plurality of lobes 42 on the tool and a plurality of shoulders 44 on the mandrel, may be useful to avoid damage to the mandrel, especially where it is formed of drillable materials. Such a tool may be collapsible or operable by twisting, key locks, etc. for removal from engagement with the mandrel after the cement float has been set.

Figure 4:
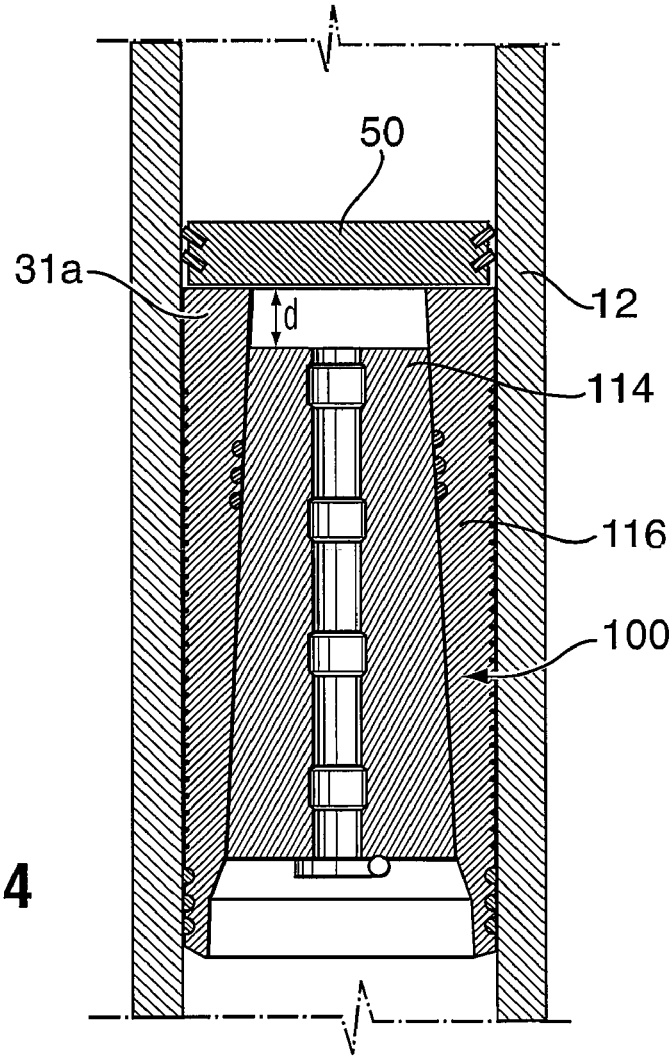
FIG. 4 is a schematic sectional view through a cement float with a displacement plug landed thereon.

In one embodiment, it may be desirable to provide a cement float that can withstand a significant force applied at the end adjacent tapered end 20*a*. For example, since the bore of a cement float may be open to flow from above, the cement float during fluid flow downwardly therepast does not generally have to withstand fluid pressure from above. However, after the cement is introduced, it is common to pump a displacement plug that lands on the top of the cement float. Once the plug lands, the operator normally increases the pressure to several hundred psi to assure that the float has landed at the correct depth. The pressure above the plug applied a mechanical downwardly directed force on the cement float. Thus, with reference to FIG. 4, a cement float 100 may be provided that ensures that any load applied by a displacement plug 50 to the cement float is directed onto the float's outer sleeve 116 instead of to the mandrel 114 so that the force does not act to push the mandrel down and unlock it from the sleeve. As such, end 31*a* of sleeve is selected to extend a distance, for example d, axially out past the end of the mandrel when the cement plug is anchored. Distance d need only be sufficient to space plug 50 from the mandrel when the plug is landed on the cement float.

Numerous modifications, variations and adaptations may be made to the particular embodiments described above without departing from the scope of the invention as defined in the claims.

The invention claimed is:

1. A cement float for use in a wellbore tubing string comprising: a mandrel including a first end, a second end, a bore extending from the first end to the second end including a fluid flow control device therein and outer side surfaces defining a tapering outer diameter from the first end of the mandrel to the second end; an outer lock sleeve including an outer surface and a sleeve bore through the sleeve, the outer lock sleeve retained at least about the outer side surfaces of the mandrel with the mandrel extending through the sleeve bore, the sleeve bore having a taper to complement and be coactable with the tapering outer diameter of the mandrel outer side surfaces and the sleeve bore and the mandrel outer side surfaces defining interfacing surfaces therebetween, the sleeve being expandable radially outwardly by driving the mandrel against the taper of the sleeve bore to place the cement float in an anchored position in the tubing string with the outer lock sleeve wedged between the mandrel and the tubing string, the outer lock sleeve and the mandrel being formed over at least a portion of their interfacing surfaces to be frictionally and/or mechanically interactive to provide self locking against sliding movement therebetween that would dislodge the cement float from its anchored position.

2. A cement float as in claim 1 wherein the sleeve extends a distance out axially past the mandrel at an end.

3. A cement float as in claim 1 wherein the outer lock sleeve is formed of a deformable material and the mandrel is formed of a material less deformable than the sleeve.

4. A cement float as in claim 1 wherein the mandrel is formed of drillable materials.

5. A method for setting a cement float in a wellbore tubular string comprising: providing a cement float including a mandrel including a first end, a second end, a bore extending from the first end to the second end including a fluid flow control device therein and outer side surfaces defining a tapering outer diameter from the first end of the mandrel to the second end; an outer lock sleeve including an outer surface and a sleeve bore through the sleeve, the outer lock sleeve retained at least about the outer side surfaces of the mandrel with the mandrel extending through the sleeve bore, the sleeve bore having a taper to complement and be coactable with the tapering outer diameter of the mandrel outer side surfaces and the sleeve bore and the mandrel outer side surfaces defining interfacing surfaces therebetween, the sleeve being expandable radially outwardly by driving the mandrel against the taper of the sleeve bore; positioning the cement float in the wellbore tubular string; using a setting tool engaged to the mandrel to apply force to the mandrel and applying an opposite force from a setting tool against the outer lock sleeve to drive the tapering outer diameter of the mandrel against the taper of the sleeve to expand the sleeve radially outwardly to both anchor the cement float in the tubular string and seal between the tubular string.

6. The method of claim 5 further comprising using the cement float and thereafter drilling the cement float out of the tubular string.

7. The method of claim 5 wherein the applying an opposite force from a setting tool against the outer lock sleeve to drive the tapering outer diameter of the mandrel against the taper of the sleeve includes holding the outer lock sleeve against axial movement and pulling the mandrel through the sleeve bore.

8. The method of claim 5 wherein the steps of applying forces to the mandrel and the outer lock sleeve to anchor the cement float drives the sleeve to create a wedge lock between the mandrel and the tubular string.

9. The method of claim 8 wherein the outer lock sleeve and the mandrel are selected to be frictionally and/or mechanically engaged together to provide self locking against sliding movement therebetween that would dislodge the cement float from its anchored position.

* * * * *